US005902100A

United States Patent [19]

Long

[11] Patent Number: 5,902,100

[45] Date of Patent: May 11, 1999

[54] GAS LANTERN WITH IGNITION SYSTEM

[75] Inventor: Norris R. Long, Wichita, Kans.

[73] Assignee: The Coleman Company, Inc., Wichita, Kans.

[21] Appl. No.: 08/941,192

[22] Filed: Sep. 30, 1997

[51] Int. Cl.[6] ..... F21H 1/00

[52] U.S. Cl. ..... 431/107; 431/109; 431/255; 431/264

[58] Field of Search ..... 431/255, 264, 431/100, 107, 109

[56] References Cited

U.S. PATENT DOCUMENTS

| | | | |
|---|---|---|---|
| 3,843,311 | 10/1974 | Nelson | 431/109 |
| 3,938,946 | 2/1976 | Phlaum | 431/264 |
| 4,337,029 | 6/1982 | McElroy et al. | 431/264 |
| 4,691,136 | 9/1987 | Schmidt | 310/339 |
| 4,870,314 | 9/1989 | Hefling | 310/339 |
| 5,039,300 | 8/1991 | Riehl | 431/264 |

OTHER PUBLICATIONS

Instructions For Use For Coleman 5154B700T Propane Lantern, Apr. 1997.

BE–PAL The Catalog—'97 RV Camping Book—cooking stove section, May 10, 1997.

*Primary Examiner*—Carroll B. Dority

*Attorney, Agent, or Firm*—Fitzpatrick, Cella, Harper & Scinto

[57] ABSTRACT

A automatic ignition gas lantern includes baffle positioned near the outside of a mantle, so that gas flowing out of the mantle will be disturbed by the baffle. This sets up a region with a fuel/air mixture that can be easily and reliably ignited. A spark is then generated in this region, which ignites the gas and causes the mantle to glow brightly.

23 Claims, 7 Drawing Sheets

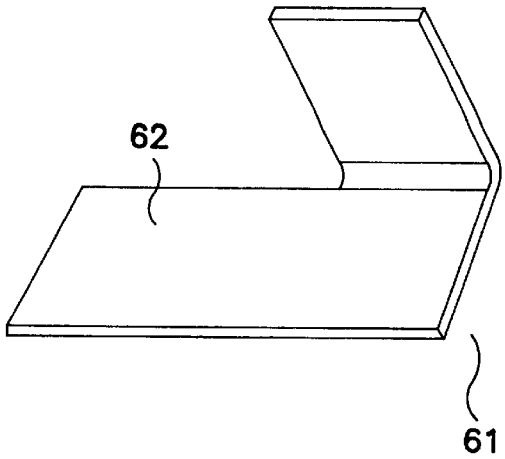
FIG. 6
FIG. 7
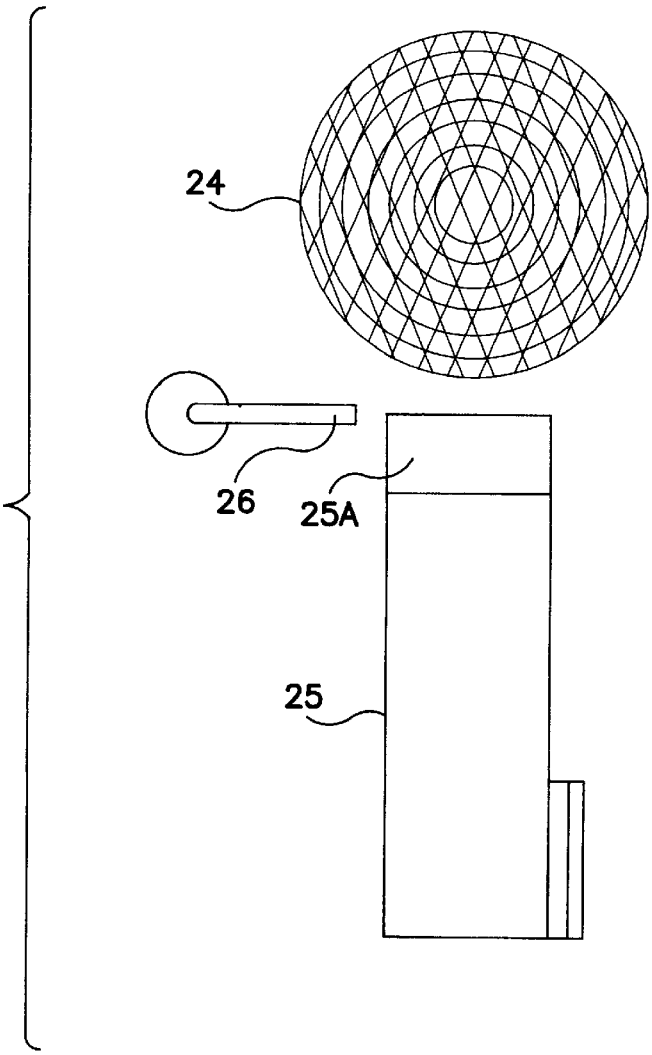

GAS LANTERN WITH IGNITION SYSTEM

BACKGROUND OF THE INVENTION

1. Field of the Invention

This invention relates to the field of lanterns that use compressed-gas fuel. More specifically, it relates to lanterns that include a gas-flow baffle to create, in the vicinity of the baffle and a mantle used with the lantern, a region having a fuel/air mixture that can be easily ignited. Once this region is established, it is ignited with a spark.

2. Description of Related Art

Lanterns that use compressed-gas fuel have been available for some time. To operate this type of lantern, the user connects the lantern to a source of compressed gas, such as a tank of propane. For ease of discussion, the invention is explained below using propane gas as an example. It is to be understood, however, that other suitable gases (including butane and mixtures of gases) may be used instead. The user then opens a valve, which allows the fuel to flow through a burner assembly and into a mantle, which is porous.

Traditionally, these lanterns are lit manually by holding a lit match near the outside of the mantle. When the gas escapes through the mantle and reaches the flame from the match, the gas starts to burn, which causes the mantle to glow brightly.

Lighting match-lit lanterns, however, can be cumbersome and inconvenient, particularly when it is dark outside. This type of lantern also suffers from a number of other disadvantages, including the inability to light the lantern if the user forgets to bring along matches, or if the matches get wet. In addition, because the mantle is extremely fragile, there is a significant risk that the mantle will be accidentally broken by the match.

To alleviate some of the problems associated with match-lit lanterns, various mechanisms have been proposed and implemented. For example, the Coleman Company Inc. makes a propane lantern, Model 5154B700T, with an electronic ignition system.

FIG. 1 is a schematic representation of the major components of that lantern. To operate that lantern, the user turns control knob 18 which opens a fuel valve 19 and releases gas into the burner 11. The gas mixes with air in the burner 11 and the fuel/air mixture flows out of the gas outlet 13 and into the mantle 14, and begins to escape through the porous mantle. In addition to opening the valve 19, turning the control knob 18 also actuates a piezoelectric spark generator 17. This spark generator 17 causes a spark to jump from a first electrode 15 to a second electrode 16. The first electrode is shaped like a blade and is about 3 cm long, 5 mm high, and 1 mm thick. Because these electrodes are positioned close to the outside of the mantle 14, the spark will ignite the gas escaping from the mantle 14, which causes the mantle. to glow.

Lanterns with electronic ignitions are significantly more convenient than the match-lit lanterns described above. With existing electronic ignition lanterns, however, sometimes the spark fails to light the lantern, particularly when the lantern is cold. Although the inventor has not performed any experiments to verify the reason, it may be because the gas in the vicinity of the mantle is moving relatively fast and has very little turbulence, which makes it difficult to ignite with a spark.

When the lantern does not light, the user can adjust the position of the electrodes and try to light the lantern again. Alternatively, the user can light the lantern using a match.

But using these backup procedures is inconvenient, and therefore defeats the main advantage of the automatic ignition lanterns.

U.S. Pat. No. 3,843,311 describes some of the difficulties of lighting a lantern by providing a spark outside of the mantle. It also describes a system which claims to improve the lighting operation by generating a spark inside the mantle. It is, however, relatively difficult to manufacture lanterns that create sparks inside the mantle.

SUMMARY OF THE INVENTION

Accordingly it is an object of this invention to provide a lighting mechanism exterior to the mantle that increases the probability of lighting the lantern and is easy to manufacture.

According to one aspect of the invention, a gas lantern which operates using a mantle is provided. The mantle may be purchased separately, or packaged together with the lantern. The lantern includes a burner having a gas outlet and two electrodes. The first electrode has a baffle section positioned so that when the mantle is disposed about the gas outlet, gas flowing out of the mantle will interact with an active surface of the baffle section to establish an ignition region having a fuel/air mixture that can be easily ignited. The second electrode is positioned so that a spark gap is formed between the second electrode and the baffle section of the first electrode, with the spark gap located in the ignition region. The lantern also includes a spark generator that, when actuated, creates a spark across the spark gap.

According to another aspect of the present invention, a gas lantern which operates using a mantle is provided. The lantern includes a burner having a gas outlet and a baffle positioned so that when the mantle is disposed about the gas outlet, gas flowing out of the mantle will interact with an active surface of the baffle to establish an ignition region having a fuel/air mixture that can be easily ignited. The lantern also includes a first electrode and a second electrode positioned so that a spark gap is formed between the second electrode and the first electrode, with the spark gap located in the ignition region. The lantern also includes a spark generator that, when actuated, creates a spark across the spark gap.

According to yet another aspect of the present invention, a gas lantern which operates using a mantle is provided. The lantern includes a burner having a gas outlet and a baffle positioned so that when the mantle is disposed about the gas outlet, gas flowing out of the mantle will be deflected by an active surface of the baffle to establish an ignition region having a fuel/air mixture that can be easily ignited. The active surface has an area of at least about 20 square mm. The lantern also includes a first electrode and a second electrode positioned so that a spark gap is formed between the second electrode and the first electrode, with the spark gap located in the ignition region. The lantern also includes a spark generator that, when actuated, creates a spark across the spark gap.

When a baffle is used in accordance with the present invention, and a spark is fired into the fuel/air mixture near the baffle, a very high ignition success rate can be achieved. Although Applicant has not performed any experiments to explain this success, it is believed that by providing a baffle near the place the gas leaves the mantle, the gas is slowed down and turbulence is introduced, forming an ignition region with an easily ignitable fuel/air mixture.

BRIEF DESCRIPTION OF THE DRAWINGS

FIG. 6 is a perspective view of another preferred igniter tab.

FIG. 7 is a top view showing a preferred arrangement of the mantle, igniter tab, and electrode.

DETAILED DESCRIPTION OF THE PREFERRED EMBODIMENTS

Figure 1:
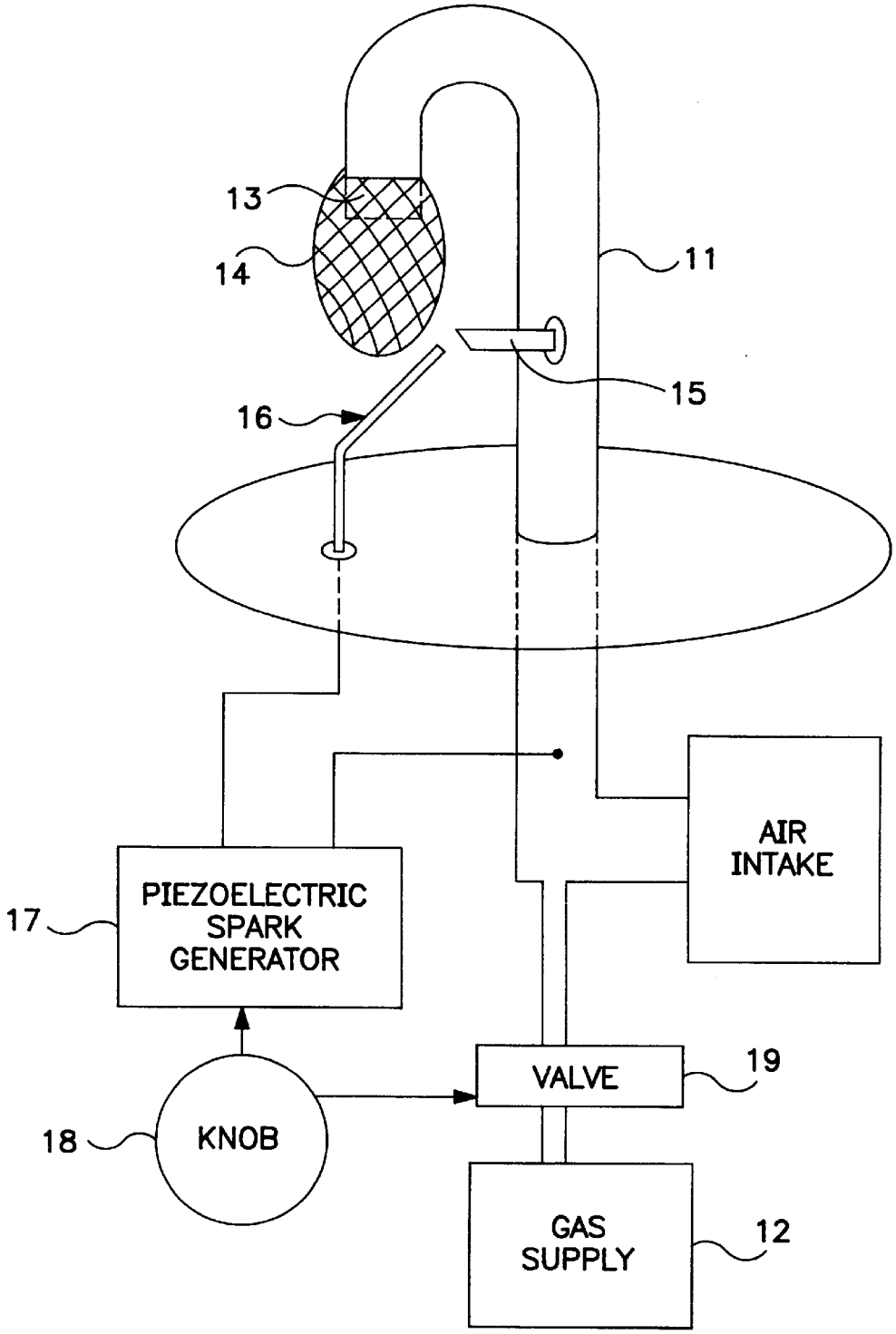
FIG. 1 PRIOR ART
FIG. 1 is a schematic representation showing certain components of a conventional lantern having an electronic ignition system.
Figure 2:
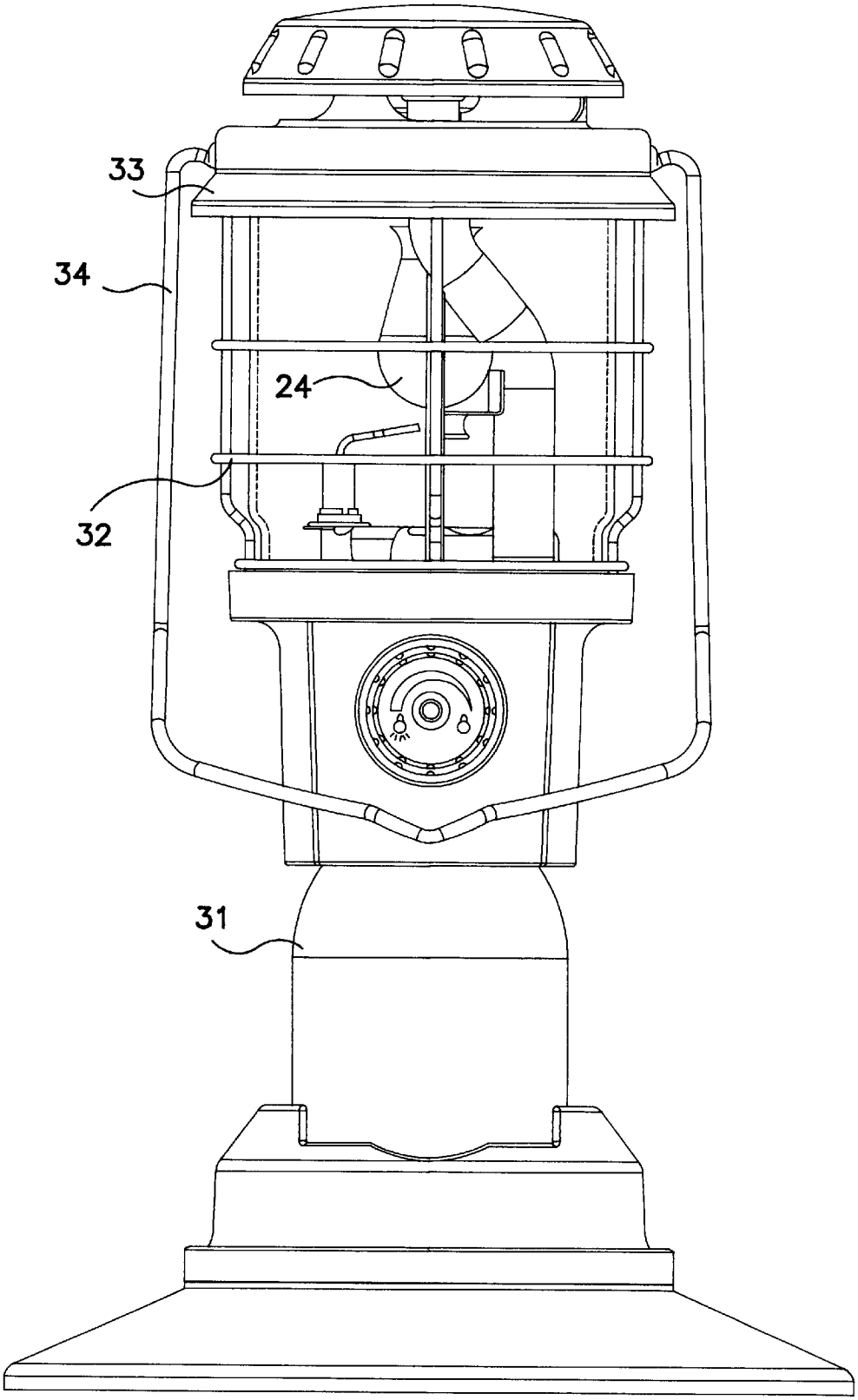
FIG. 2 shows a lantern in accordance with a preferred embodiment of the present invention, together with various associated components.

FIG. 2 is a view of a lantern in accordance with a preferred embodiment of the present invention, assembled together with other components such as a mantle 24, a gas tank 31, a safety cage 32, a ventilator 33, and a handle 34. In the illustrated combination, the lantern is ready for use.

Figure 3A:
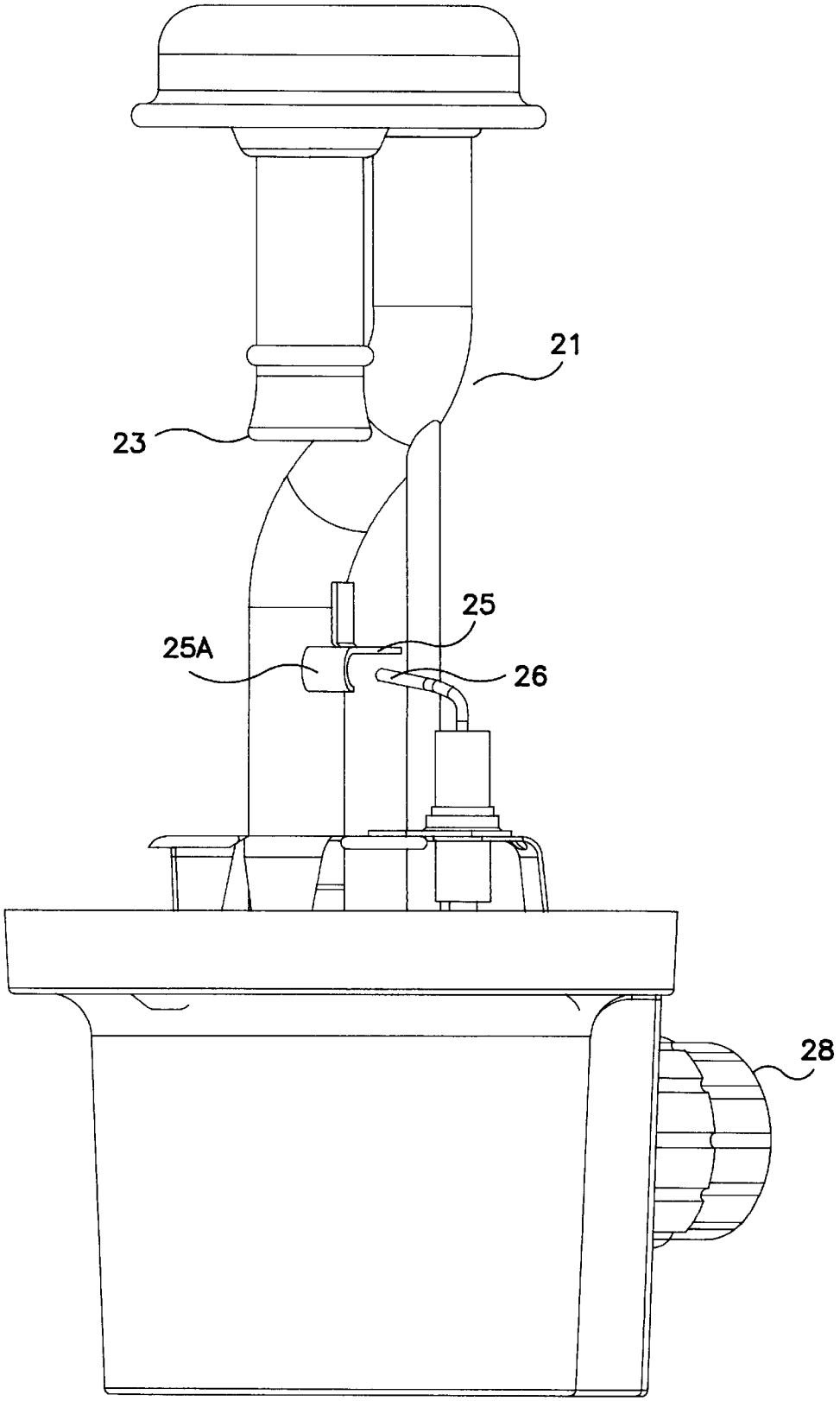
FIG. 3A is a first side elevation of a lantern in accordance with a preferred embodiment of the present invention.
Figure 3B:
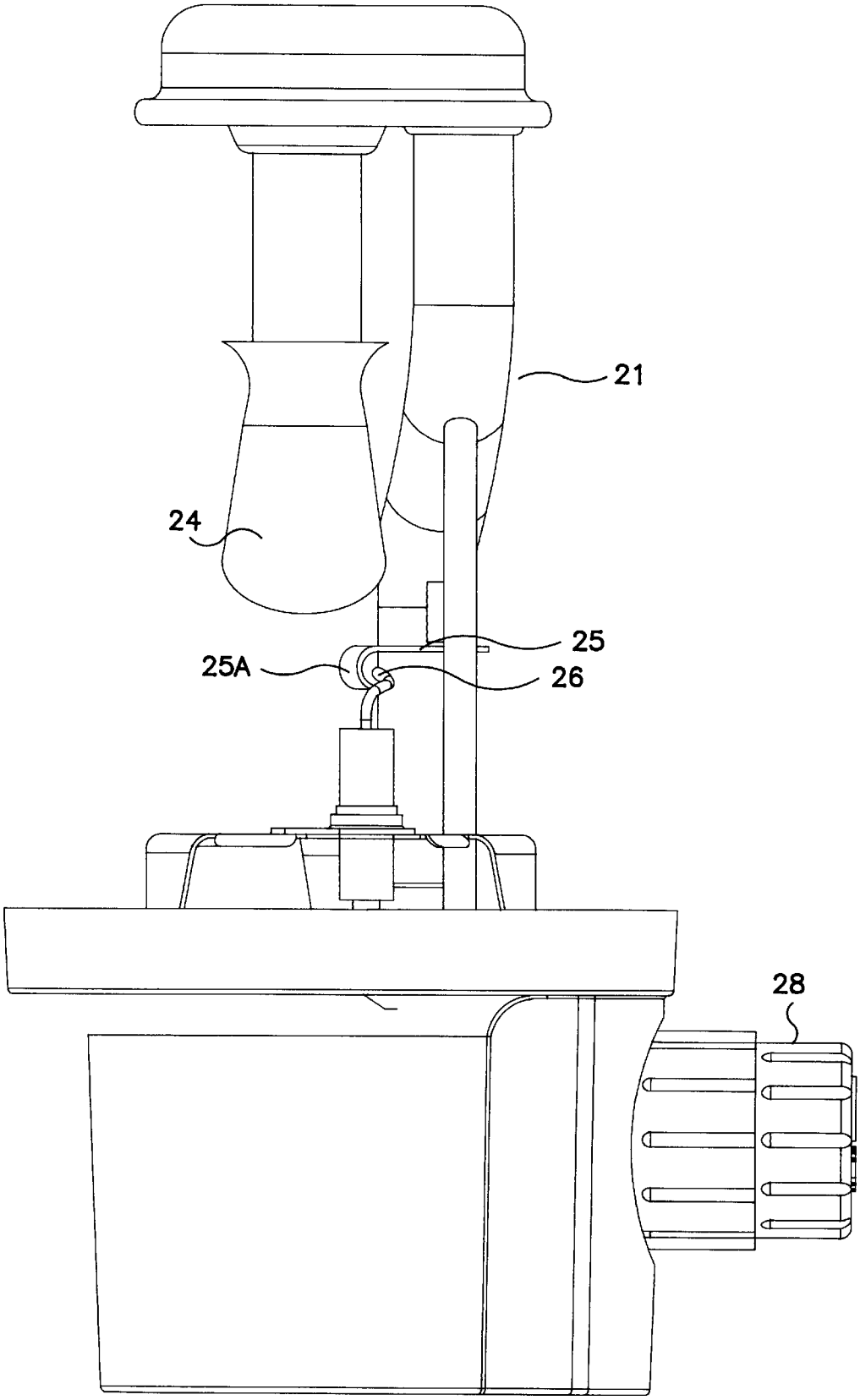
FIG. 3B is a second side elevation of a lantern in accordance with a preferred embodiment of the present invention (with a mantle installed on the lantern).

FIGS. 3A and 3B are two side elevations, from different angles, of a lantern in accordance with a preferred embodiment of the present invention. In FIG. 3B, a mantle 24 is installed on the lantern. When the lantern is connected to the fuel supply (not shown) the control knob 28 turns a valve (not shown) that controls the flow of fuel into the lantern. One of the most popular fuels for this type of lantern is compressed propane gas, which is typically provided in a small fuel cylinder (or tank).

When the lantern is connected to the fuel supply (in any conventional manner) and the control knob 28 is turned to open the fuel valve, the propane flows out of the supply tank and into the burner 21. The propane mixes with air and flows through the burner 21 and out of the gas outlet 23. Ordinarily, a mantle 24 will be tied or clipped onto the gas outlet 23 so that the gas flowing out of the gas outlet 23 will flow into and through the mantle 24. The mantle 24 is formed of a screen-like material, with many small holes (not shown). The gas flows out of the tiny holes in the mantle 24 and escapes into the environment. Normally, the propane leaving the mantle will tend to flow downward, primarily because of the initial downward velocity of the gas escaping from the pressurized tank. A secondary cause for this downward flow is that propane is heavier than air.

An igniter tab 25 is installed near the bottom of the mantle 24. The igniter tab 25 includes a baffle section 25*a*. When gas flowing out of the mantle arrives at the baffle section 25*a*, it impinges on active surface of the baffle section 25*a*, which disturbs the ordinary flow of gas. Preferably, the active surface has an area of at least about 20 square mm, and more preferably at least about 40 square mm. While it is believed that the baffle section 25*a* slows the gas down and introduces turbulence into the gas stream, the exact nature of the disturbance has not been experimentally verified. However, it has been demonstrated to form a fuel/air mixture in the vicinity of the baffle section 25*a* that can be easily and reliably ignited. The region of this fuel/air mixture is called the ignition region. Preferably, the igniter tab 25 (including the baffle section 25*a*) is made of a conductive material such as metal and also serves as the first electrode, as explained below.

In one preferred embodiment, the baffle section 25*a* at the end of the igniter tab 25 is curved to provide a half-cylindrical face. This shape reduces the probability of a mantle being snagged or torn on a sharp edge of the baffle section 25*a* while being installed. This shape also provides a baffle section 25*a* that can interfere with the flow of gas arriving from the side as well as gas arriving from above, which may improve the baffling effect. A preferred radius for the cylinder is between about 2 mm and about 4 mm, although other radii may be used as well. While a half-cylindrical face is preferred, other part-cylindrical faces (e.g. a quarter cylinder) may be used instead.

Alternatively, non-cylindrical shapes may be used. For example, in another preferred embodiment, the igniter tab shown in FIGS. 3A, 3B, and 5A through 5D is replaced with a flat igniter tab 61 (shown in FIG. 6). In this embodiment, the active surface of the baffle section 62 is flat and substantially perpendicular to the downward flow of gas arriving at the baffle section 62.

Once a suitable ignition region has been established in the vicinity of the baffle section, the fuel/air mixture can be easily ignited by a spark.

A spark gap is established by placing a second electrode 26 a short distance away from the baffle section 25*a* of the igniter tab 25. Preferably, this spark gap is between about 1 and about 5 mm, and most preferably about 3 mm long. Larger spark gaps of up to 1 cm or even longer may also be used, provided that a spark generator capable of jumping the spark gap is used.

The spark gap may be positioned to spark to the edge of the baffle section 25*a*, as shown in FIGS. 3A and 3B. This is also illustrated in FIG. 7, which is a top view of a preferred arrangement for the mantle 24, igniter tab 25, and second electrode 26. Alternatively, the spark gap may be positioned to spark to the active face of the baffle section 25*a* by moving the second electrode closer to the middle of the active surface.

Figure 4:
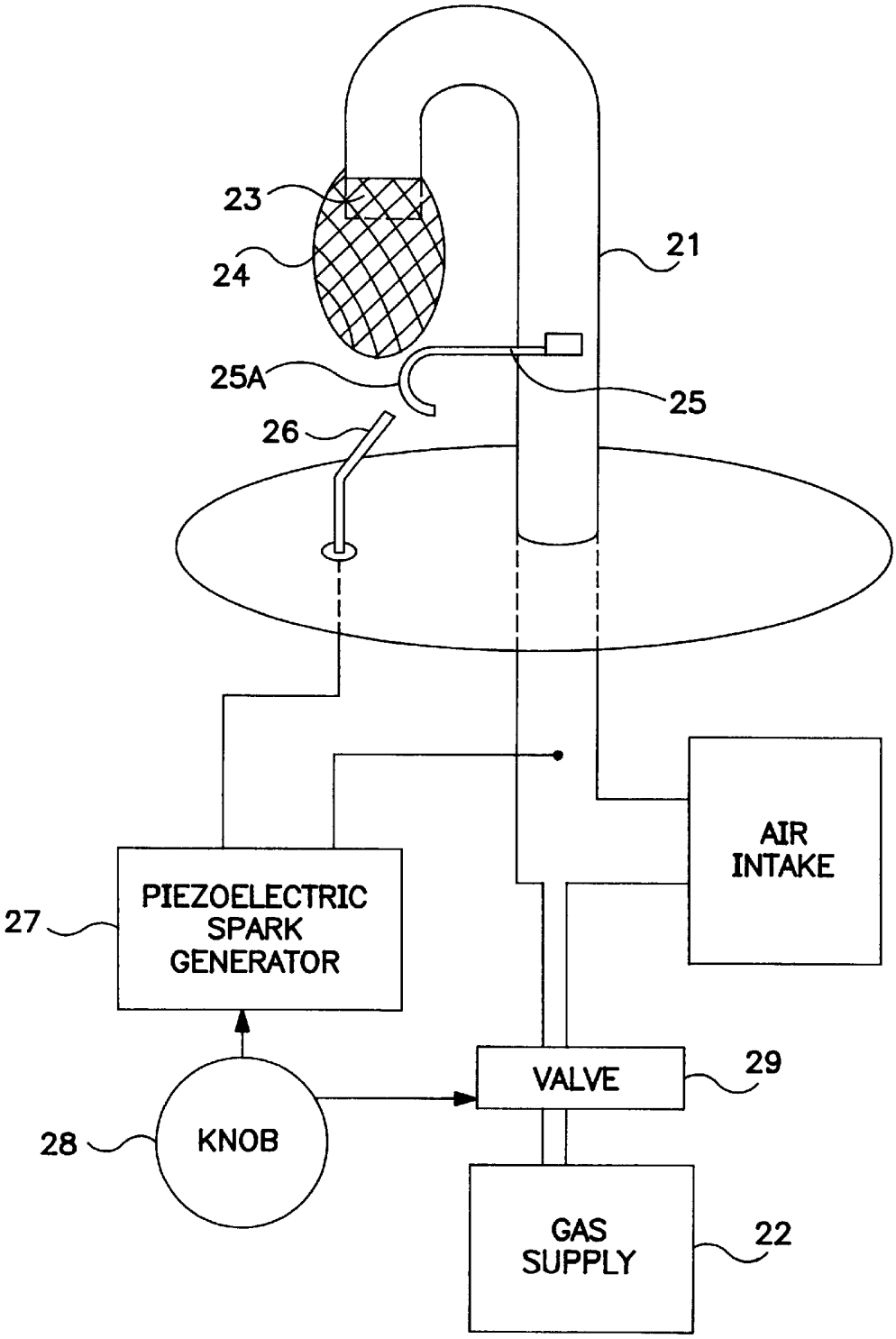
FIG. 4 is a schematic representation showing certain components of a lantern in accordance with a preferred embodiment of the present invention (with a mantle installed on the lantern).
Figure 5A:
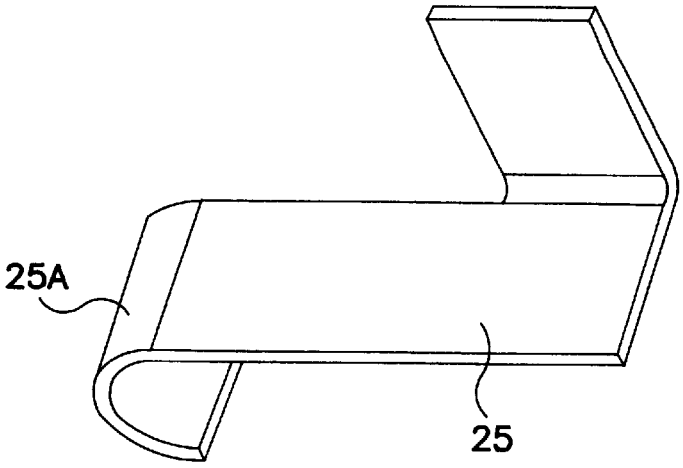
FIG. 5A is a detailed perspective view of a preferred igniter tab for use in a preferred embodiment of the present invention.
Figure 5B:
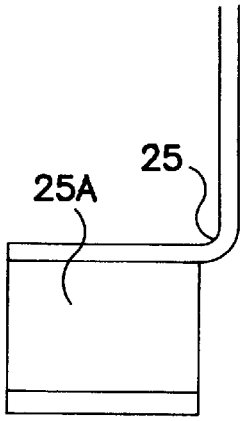
FIG. 5B is a rear view of the igniter tab of FIG. 5A.
Figure 5C:
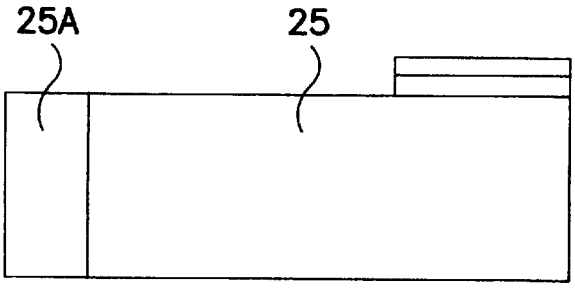
FIG. 5C is a top view of the igniter tab of FIG. 5A.
Figure 5D:
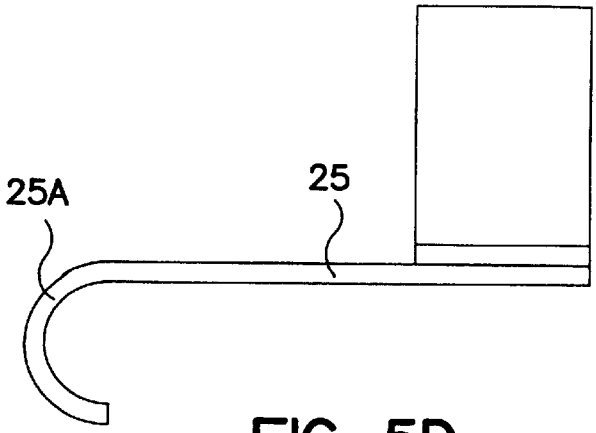
FIG. 5D is a side view of the igniter tab of FIG. 5A.

FIG. 4 is a schematic representation of the major components of a lantern in accordance with a preferred embodiment of the present invention. The igniter tab 25 serves as the first electrode, and is electrically connected to one terminal of the spark generator 27. The other terminal of the spark generator is electrically connected to the second electrode. When actuated, the spark generator 27 generates a spark between the second electrode 26 and the baffle section 25*a* of the first electrode, i.e., the igniter tab 25.

When a metal burner is used, a direct wired connection between the spark generator and the first electrode is not required. Instead, the first electrode 25 may be welded (e.g., spot welded or brazed) to the burner, and the spark generator may be electrically connected to another spot on the burner 21. The burner 21 will then conduct the electricity to the first electrode 25. The second electrode 26 may be insulated from the body of the lantern as described in U.S. Pat. No. 4,691,136, which is incorporated herein by reference.

The user actuates the spark generator 27 using a suitable actuator such as control knob 28. The spark generator 27 then induces a voltage difference between the second electrode 26 and the first electrode 25. Because the first electrode is connected to the metal burner, it serves as an electrical ground. When this voltage difference reaches a sufficient level, a spark jumps across the spark gap. Because the second electrode 26 is closer to the baffle section 25*a* than to any other part of the first electrode, i.e., the igniter tab 25, the spark will always jump to the baffle section 25*a*.

The spark generator 27 may be a conventional piezoelectric device. While piezoelectric spark generators are preferred, the particular type of spark generator is not critical to the present invention, and other types of spark generators may be used as well.

The spark generator 27 may be actuated by the rotation of the same control knob 28 that allows the gas to flow into the burner, in a conventional manner. One suitable mechanism for providing this feature is disclosed in U.S. Pat. No. 4,870,314, which is incorporated herein by reference. It describes a cam mechanism for actuating a pushbutton piezoelectric ignition device when a control knob is rotated. This feature allows a single control knob to control both the flow of gas and the ignition.

When the spark generator is actuated, the spark will jump the spark gap and ignite the fuel/air mixture that is established in the ignition region (as described above), which lights the lantern.

FIGS. 5A, 5B, 5C, and 5D are detailed views showing, respectively, perspective, rear, top, and side views of a preferred igniter tab 25 in accordance with the present invention.

It has been found that a lantern made in accordance with the present invention will almost always light on the first spark when the lantern is hot, and on the first or second spark when the lantern is cold.

While the present invention has been described with reference to specific embodiments, numerous alternative embodiments may be substituted for those described above, as will be appreciated by those skilled in the art. For example, instead of using a conducting igniter tab to both baffle the flow of gas and serve as the first electrode, as described above, the invention can be implemented using a first electrode that is not integral to the baffle. One way to accomplish this would be to use the igniter tab described above to baffle the gas, but to draw a spark to an independently provided electrode with its tip located in the ignition region.

In the embodiment shown in the drawings, the mantle has an opened end at the top and a closed end at the bottom. The fuel/air mixture enters the mantle from the top end and flows through the holes in the mantle, and the baffle section is located below the bottom end of the mantle. In an alternative preferred embodiment, the baffle may be moved up as high as the half-way point between the two ends of the mantle, or even higher up.

In another alternative embodiment, the mantle could be inverted, with the gas outlet located below the mantle so that the fuel air mixture shoots into the mantle from the bottom. In yet another alternative embodiment, the conventional closed-end mantle shown in the figures could be replaced with a conventional mantle of the type that is opened at both the top and the bottom.

The individual components designated by blocks in the drawings are all known in the lantern arts and their specific construction and operation are not critical to the operation or best mode for carrying out the present invention.

It is to be understood that the invention is not limited to the specific embodiments described above, and that various changes and modifications can be effected without departing from the scope or spirit of the present invention.

What is claimed is:

1. A gas lantern which operates using a mantle, the lantern comprising:

a burner having a gas outlet about which a mantle is disposed;

a first electrode having a baffle section with a surface and an edge, wherein the surface is broader than the edge and the surface faces the mantle, and the baffle section is positioned so that gas flowing out of the mantle will interact with the baffle section to establish an ignition region having a fuel/air mixture that can be easily ignited;

a second electrode positioned so that a spark gap is formed between the second electrode and the baffle section of the first electrode, with the spark gap located in the ignition region; and a spark generator to selectively create a spark across the spark gap.

2. The gas lantern according to claim 1, wherein the surface of the baffle section is substantially perpendicular to a direction of flow of gas arriving at the surface of the baffle section.

3. The gas lantern according to claim 1, wherein the baffle section and the gas outlet are located on opposite ends of the mantle.

4. The gas lantern according to claim 1, wherein the baffle section and the gas outlet are located on opposite ends of a point half way between the ends of the mantle.

5. The gas lantern according to claim 1, wherein the baffle section is part-cylindrical with a longitudinal axis of the cylinder substantially perpendicular to a direction of flow of gas arriving at the baffle section.

6. The gas lantern according to claim 5, wherein the baffle section is half-cylindrical.

7. The gas lantern according to claim 6, wherein a radius of curvature of the baffle section is between about 2 and about 4 mm.

8. The gas lantern according to claim 1, wherein the spark gap extends between the second electrode and an edge of the baffle section.

9. The gas lantern according to claim 1, wherein the spark gap extends between the second electrode and the surface of the baffle section.

10. The gas lantern according to claim 1, wherein the baffle section and the gas outlet are located on opposite ends of a point half way between the ends of the mantle, the baffle section is part-cylindrical with a longitudinal axis of the cylinder substantially perpendicular to a direction of flow of gas arriving at the baffle section, and the spark gap extends between the second electrode and an edge of the baffle section.

11. A gas lantern which operates using a mantle, the lantern comprising:

a burner having a gas outlet about which a mantle is disposed;

a baffle with a surface and a edge, wherein the surface is broader than the edge and the surface faces the mantle, and the baffle is positioned so that gas flowing out of the mantle will interact with the surface of the baffle to establish an ignition region having a fuel/air mixture that can be easily ignited;

a first electrode;

a second electrode positioned so that a spark gap is formed between the second electrode and the first electrode, with the spark gap located in the ignition region; and a spark generator to selectively create a spark across the spark gap.

12. The gas lantern according to claim 11, wherein the surface of the baffle is substantially perpendicular to a direction of flow of gas arriving at the surface of the baffle.

13. The gas lantern according to claim 11, wherein the baffle and the gas outlet are located on opposite ends of the mantle.

14. The gas lantern according to claim 11, wherein the baffle and the gas outlet are located on opposite ends of a point half way between the ends of the mantle.

15. The gas lantern according to claim 11, wherein the baffle is part-cylindrical with a longitudinal axis of the cylinder substantially perpendicular to a direction of flow of gas arriving at the baffle.

16. The gas lantern according to claim 15, wherein the baffle is half-cylindrical.

17. The gas lantern according to claim 16, wherein a radius of curvature of the baffle is between about 2 and about 4 mm.

18. The gas lantern according to claim 11, wherein the spark gap extends between the second electrode and an edge of the baffle.

19. The gas lantern according to claim 11, wherein the spark gap extends between the second electrode and the surface of the baffle.

20. The gas lantern according to claim 11, wherein the baffle and the gas outlet are located on opposite ends of a point half way between the ends of the mantle, the baffle is part-cylindrical with a longitudinal axis of the cylinder substantially perpendicular to a direction of flow of gas arriving at the baffle.

21. A gas lantern which operates using a mantle, the lantern comprising:

a burner having a gas outlet about which a mantle is disposed;

a baffle having a surface that faces the mantle positioned so that gas flowing out of the mantle will impinge on the surface of the baffle the surface having an area of at least about 20 square mm, to establish an ignition region having a fuel/air mixture that can be easily ignited;

said baffle serving as a first electrode;

a second electrode positioned so that a spark gap is formed between the second electrode and the first electrode, with the spark gap located in the ignition region; and a spark generator to selectively create a spark across the spark gap.

22. The gas lantern according to claim 21, wherein the surface has an area of at least about 40 square mm.

23. The gas lantern according to claim 21, wherein the surface of the baffle is substantially perpendicular to a direction of flow of gas arriving at the surface of the baffle.

* * * * *